US009506469B2

(12) United States Patent
Morita et al.

(10) Patent No.: US 9,506,469 B2
(45) Date of Patent: Nov. 29, 2016

(54) VENTED MOTOR SEAL FOR A COMPRESSOR

(75) Inventors: Kenji Morita, Shizuoka (JP); Hideharu Tanaka, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 46 days.

(21) Appl. No.: 13/360,930

(22) Filed: Jan. 30, 2012

(65) Prior Publication Data

US 2012/0257997 A1 Oct. 11, 2012

(30) Foreign Application Priority Data

Apr. 5, 2011 (JP) ..... 2011-084008

(51) Int. Cl.
*F04C 29/00* (2006.01)
*F04C 27/00* (2006.01)
(Continued)

(52) U.S. Cl.
CPC ..... *F04C 29/005* (2013.01); *F04C 27/009* (2013.01); *F04C 29/0085* (2013.01); *F04D 29/043* (2013.01); *F04D 29/102* (2013.01); *F04C 18/16* (2013.01)

(58) Field of Classification Search
CPC .. F04D 29/0405; F04D 29/043; F04D 29/08; F04D 29/40; F04D 29/05; F04D 29/053; F04D 29/054; F04D 29/083; F04D 29/086; F04D 29/10; F04D 29/102; F04D 29/12; F04C 15/0034; F04C 15/0038; F04C 15/0057; F04C 15/0061; F04C 27/009; F04C 27/008; F04C 29/0085; F04C 29/005; F04C 2240/40; F04C 2240/603; F04C 18/16
USPC ..... 417/423.6, 423.7, 423.11, 423.15, 417/410.5, 410.4; 310/85
See application file for complete search history.

(56) References Cited

U.S. PATENT DOCUMENTS 3,909,154 A * 9/1975 Robb et al. ..... 415/110
4,291,547 A * 9/1981 Leo ..... F04C 27/009 418/200

(Continued)

FOREIGN PATENT DOCUMENTS

JP 60-32990 A 2/1985
JP 2-196187 A 8/1990

(Continued)

OTHER PUBLICATIONS

Japanese Office Action dated May 20, 2014 with English Translation (six (6) pages).

*Primary Examiner* — Bryan Lettman
*Assistant Examiner* — Timothy Solak
(74) *Attorney, Agent, or Firm* — Crowell & Moring LLP

(57) ABSTRACT

An air compressor includes a compressor body, an electric motor, a gear mechanism, a gear casing, a partitioning wall, and a screw seal. The screw seal locates in a through hole formed to the partitioning wall, where a rotating shaft of the electric motor passes through, and makes an air flow from the electric motor side to the gear mechanism side in the through hole with rotating of the rotation shaft. The air compressor also includes a bearing that supports that rotating shaft is arranged to the gear mechanism side of the partitioning wall, such that a rotor of the electric motor has overhang structure. The air compressor also includes a communication hole that communicates the electric motor side from the screw seal of the through hole and an outside of the air compressor not through the internal space of the casing of the electric motor.

2 Claims, 2 Drawing Sheets

(51) Int. Cl.

| | |
|---|---|
| ***F04D 29/043*** | (2006.01) |
| ***F04D 29/10*** | (2006.01) |
| *F04C 18/16* | (2006.01) |

(56) References Cited

U.S. PATENT DOCUMENTS

| | | | | |
|---|---|---|---|---|
| 4,984,974 | A * | 1/1991 | Naya | F04C 27/009 277/350 |
| 4,997,340 | A * | 3/1991 | Zinsmeyer | F04D 29/102 415/105 |
| 5,295,808 | A * | 3/1994 | Machida et al. | 417/366 |
| 5,846,062 | A * | 12/1998 | Yanagisawa et al. | 417/410.4 |
| 5,911,561 | A * | 6/1999 | Kathmann | 417/273 |
| 6,287,088 | B1 | 9/2001 | Nishimura et al. | |
| 6,572,350 | B2 * | 6/2003 | Takahashi | F04C 23/00 137/100 |
| 2002/0044876 | A1 * | 4/2002 | Yoshimura | 417/410.4 |
| 2004/0037711 | A1 * | 2/2004 | Nishimura | 417/297 |
| 2007/0134111 | A1 * | 6/2007 | Eybergen et al. | 417/423.6 |
| 2008/0240963 | A1 | 10/2008 | Kimura et al. | |
| 2008/0240965 | A1 | 10/2008 | Kimura et al. | |
| 2009/0028730 | A1 * | 1/2009 | Radermacher et al. | 417/423.8 |

FOREIGN PATENT DOCUMENTS

| | | | |
|---|---|---|---|
| JP | 2000-97186 | A | 4/2000 |
| JP | 2004-176699 | A | 6/2004 |
| JP | 2005-90371 | A | 4/2005 |
| JP | 2008-255797 | A | 10/2008 |
| JP | 2008-255798 | A | 10/2008 |

* cited by examiner

VENTED MOTOR SEAL FOR A COMPRESSOR

This application claims the priority of Japanese Patent Application No. JP 2011-084008, filed Apr. 5, 2011, the disclosure of which is expressly incorporated by reference herein in its entirety.

TECHNICAL FIELD

The present subject matter relates to an air compressor in which a non-contact type seal is provided in a gap in a portion where a rotating shaft of an electric motor penetrates through a partitioning wall that defines an internal space of a gear casing and an internal space of an electric motor casing.

BACKGROUND

An air compressor including a compressor body that compresses air, an electric motor for a power source for the compressor body, a gear mechanism that transmits power of the electric motor to the compressor body, and a gear casing that is connected between a casing of the compressor body and a casing of the electric motor and houses, e.g., the gear mechanism is known (for example, JP-A No. 2000-97186). The air compressor has a partitioning wall (part of a gear casing in JP-A No. 2000-97186) that defines the internal space of the gear casing and the internal space of the casing of the electric motor. A non-contact type seal is provided in a gap in a portion where a rotating shaft of the electric motor penetrates through the partitioning wall.

The seal has a threaded inner circumferential surface to generate a flow from the electric motor casing toward the gear casing when a rotating shaft of the electric motor rotates. This prevents lubricant in the gear casing from intruding into the casing of the electric motor.

SUMMARY

However, there is room for the following improvements in the above related technology. That is, in the above related technology, the seal is provided to the gap in the portion where the rotating shaft of the electric motor penetrates through the partitioning wall that defines the internal space of the gear casing and the internal space of the electric motor. This generates a flow from the electric motor casing to the gear casing when the rotating shaft of the electric motor rotates. Accordingly, a negative pressure is generated from the seal toward the electric motor, and then a negative pressure is generated in the internal space of the casing of the electric motor. When a small gap is produced in the casing of the electric motor, ambient air (the atmosphere) is sucked into the internal space of the casing of the electric motor. When the suction of ambient air continues over a long period of time, dust contained in the ambient air may accumulate to cause a failure such as overheat.

An object of the present subject matter is to provide an air compressor in which the intrusion of dust into a casing of an electric motor can be prevented to improve reliability.

(1) For addressing the above object, an air compressor includes: a compressor body that compresses air; an electric motor as a power source for the compressor body; a gear mechanism that transmits power of the electric motor to the compressor body; a gear casing that is connected between a casing of the compressor body and a casing of the electric motor and houses the gear mechanism; a partitioning wall that defines an internal space of the gear casing and an internal space of the casing of the electric motor; and a non-contact type seal provided in a gap in a portion where a rotating shaft of the electric motor penetrates through the partitioning wall to prevent the intrusion of lubricant in the gear casing into the casing of the electric motor. A communication hole that communicates between a gap from the seal toward the electric motor in the partitioning wall and the outside of the air compressor not through the internal space of the casing of the electric motor is formed.

(2) In (1), the communication hole is preferably formed in the partitioning wall.

(3) In (2), it is preferable that the non-load side end of the rotating shaft of the electric motor extends to the outside through the casing of the electric motor. A contact type seal is provided to a gap in a portion where the non-load side end of the rotating shaft of the electric motor penetrates through the casing of the electric motor. The communication hole is formed in the rotating shaft of the electric motor and extends to the non-load side end surface of the shaft.

In the present subject matter, a seal generates a flow from the electric motor casing toward the gear casing when the rotating shaft of the electric motor rotates. At this time, ambient air can be supplied to the gap from the seal toward the electric motor in the partitioning wall via the communication hole to prevent generation of a negative pressure in the internal space of the casing of the electric motor. Therefore, even when a small gap is produced in the casing of the electric motor, it is possible to prevent intrusion of dust into the electric motor casing for improving reliability.

BRIEF DESCRIPTION OF THE SEVERAL VIEWS OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Figure 1:
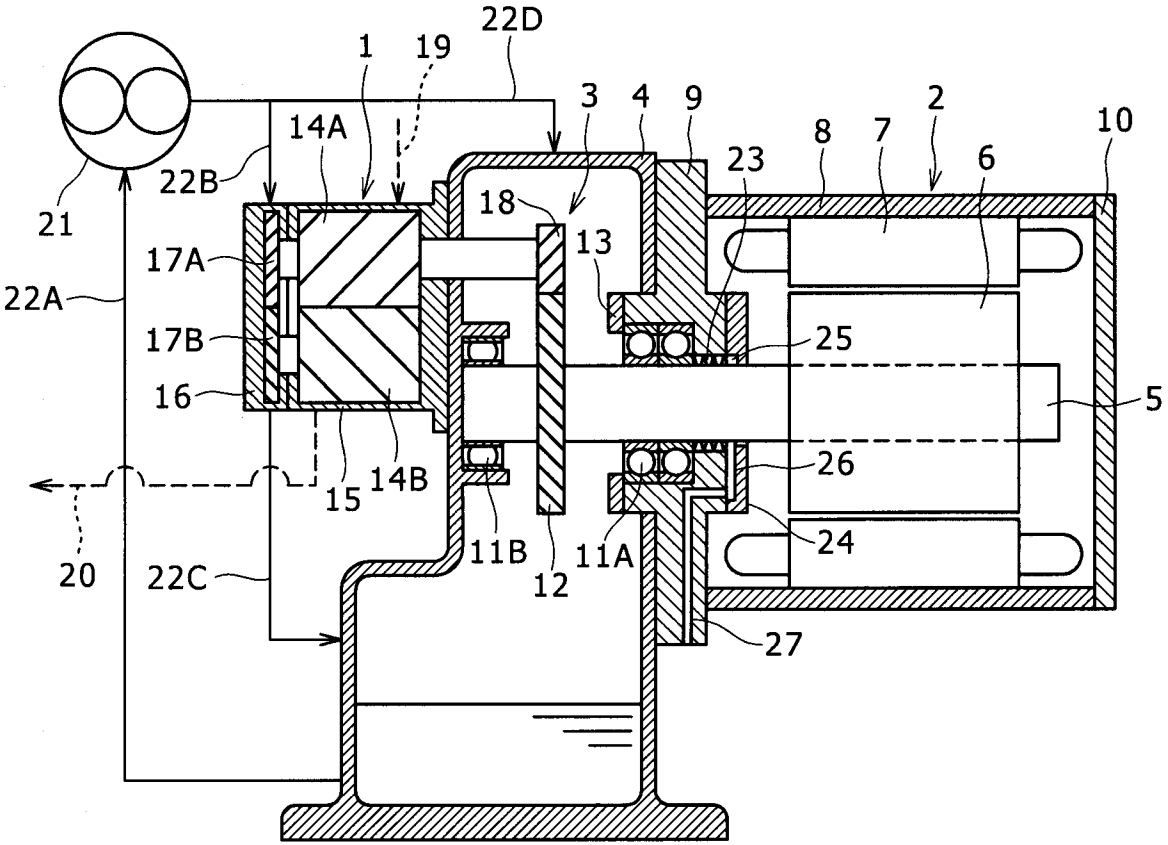
FIG. 1 shows a cross sectional structure of an air compressor in a first example together with an air system and an oil system.

FIG. 1 explains a first example. FIG. 1 shows a cross sectional structure of an air compressor in this example together with an air system and an oil system.

In FIG. 1, the air compressor includes a compressor body 1 that compresses air, an electric motor (for example, a permanent magnet electric motor) 2 as a power source for the compressor body 1, a gear mechanism 3 that transmits power of the electric motor 2 to the compressor body 1, and a gear casing 4 that houses, e.g., the gear mechanism 3.

The electric motor 2 includes: a rotating shaft 5; a rotor 6 attached to the rotating shaft 5; a stator 7 arranged externally of the periphery of the rotor 6; an electric motor main casing 8 to which the stator 7 is secured; a load side casing 9 connected to a rotary-axial load side (left in FIG. 1) of the electric motor main casing 8; and a non-load side casing 10 connected to a rotary-axial non-load side (right in FIG. 1) of the electric motor main casing 8. The load side casing 9 is connected to one side surface (right in FIG. 1) of the gear casing 4.

A load side end of the rotating shaft 5 extends into the gear casing 4 through the load side casing 9, and is rotatably supported by a bearing 11A provided to the load side casing 9 and a bearing 11B provided to the gear casing 4. That is, the rotor 6 located in the electric motor main casing 8 has an overhang relative to the bearings 11A and 11B. A drive gear 12 is provided to the load side end of the rotating shaft 5. A bearing cover 13 that covers the bearing 11A is attached to the load side casing 9.

The compressor body 1, which is a screw type, includes: a male rotor 14A and a female rotor 14B whose axial directions are generally in parallel and which rotate to mesh one another; a compressor main casing 15 that houses tooth portions of the male rotor 14A and female rotor 14B; and a discharge casing 16 connected to a rotor-axial discharge side (left in FIG. 1) of the compressor main casing 15. The compressor main casing 15 is connected to the other side surface (left in FIG. 1) of the gear casing 4.

Shaft portions of the discharge side (left in FIG. 1) and suction side (right side in FIG. 1) of the male rotor 14A are rotatably supported by bearings (not shown). Similarly, shaft portions of the discharge side and suction side of the female rotor 14B are rotatably supported by bearings (not shown). Timing gears 17A and 17B are provided to the discharge side shaft portions of the male rotor 14A and female rotor 14B to rotate the male rotor 14A and female rotor 14B synchronously in a non-contact manner. The suction side shaft portion of the male rotor 14A extends from the compressor main casing 15 into the gear casing 4, and has a driven gear 18.

The gear mechanism 3 is structured by the mesh of the drive gear 12 and driven gear 18. Torque of the electric motor 2 is transmitted to the male rotor 14A via the gear mechanism 3 to rotate the male rotor 14A, and then to rotate the female rotor 14B via the timing gears 17A and 17B. With rotation of the male rotor 14A and female rotor 14B, a volume of a compression chamber changes as the compression chamber moves to the rotor-axial discharge side. Thus, air is sucked from a suction flow path 19 and compressed, and compressed air is discharged to a discharge flow path 20.

Lubricant accumulates in the lower portion of the gear casing 4. The oil system is provided to supply the lubricant to the timing gears 17A and 17B, gear mechanism 3, bearings 11A and 11B, etc. The oil system includes an oil pump 21, an oil piping 22A connected between the suction side of the oil pump 21 and the lower portion of the gear casing 4, an oil piping 22B connected between the discharge side of the oil pump 21 and the discharge casing 16 of the compressor body 1, an oil piping 22C connected between the discharge casing 16 of the compressor body 1 and the lower portion of the gear casing 4, and an oil piping 22D diverging from the oil piping 22B and connected to the upper portion of the gear casing 4. A communication hole (not shown) for taking in ambient air (the atmosphere) is provided to the upper portion of the gear casing 4 to maintain the internal pressure of the gear casing 4 at or below outside air pressure.

A seal 23 is provided in a gap in a portion where the rotating shaft 5 of the electric motor 2 penetrates through the load side casing 9 (specifically, a gap from the bearing 11A toward the electric motor 2). A seal cover 24 made of, e.g., aluminum to cover the seal 23 is attached to the load side casing 9. The inner circumferential surface of the seal 23 is threaded to generate a flow from the electric motor main casing 8 toward the gear casing 4 when the rotating shaft 5 rotates. This prevents lubricant in the gear casing 4 from intruding into the electric motor main casing 8. However, at this time, a negative pressure is generated from the seal 23 toward the electric motor 2. When this situation continues, a negative pressure may be generated in the internal space of the electric motor main casing 8.

Then, in this example, a generally-circular groove 25 larger than a through hole through which the rotating shaft 5 passes and a communication groove (communication hole) 26 extending from the groove 25 downward (that is, radially outward) are formed to the seal cover 24. A gap between the side surface (inner circumferential surface) of the groove 25 of the seal cover 24 and the outer circumferential surface of the rotating shaft 5 is larger than a gap between the inner circumferential surface of a portion from the groove 25 toward the electric motor 2 in the seal cover 24 and the outer circumferential surface of the rotating shaft 5. A flow path cross section of the communication groove 26 of the seal cover 24 is larger than a gap between the inner circumferential surface of a portion from the groove 25 toward the electric motor 2 in the seal cover 24 and the outer circumferential surface of the rotating shaft 5. A communication hole 27 that communicates with the communication groove 26 of the seal cover 24 and is open downward to communicate with the outside is formed in the load side casing 9.

That is, in this example, the load side casing 9 and seal cover 24 form a partitioning wall defining the internal space of the gear casing 4 and the internal space of the electric motor main casing 8. The gap from the seal 23 toward the electric motor 2 in the partitioning wall (that is, the gap in the groove 25) and the outside of the air compressor communicate with one another via the communication holes 26, 27 not through the internal space of the electric motor main casing 8. Accordingly, ambient air can be supplied to the gap from the seal 23 toward the electric motor 2 via the communication holes 26, 27 to prevent generation of a negative pressure in the internal space of the electric motor main casing 8. Therefore, even when a small gap is produced in the casing of the electric motor 2 (as one example, even when a small gap is created to the connection portion of the electric motor main casing 8 and load side casing 9), dust can be prevented from intruding into the electric motor main casing 8 for improving reliability.

As shown, the first example is described in the example in which the non-load side end of the rotating shaft 5 of the electric motor 2 does not penetrate through the non-load side casing 10, but not limited to this example. That is, for example, the non-load end of the rotating shaft 5 of the electric motor 2 may extend to the outside through the non-load side casing 10, and a contact type seal may be provided to the gap in the penetration portion of the rotating shaft 5 in the non-load casing 10 (or a non-load side seal cover attached thereto). Also in such a case, the same advantageous effect as described above can be obtained.

Figure 2:
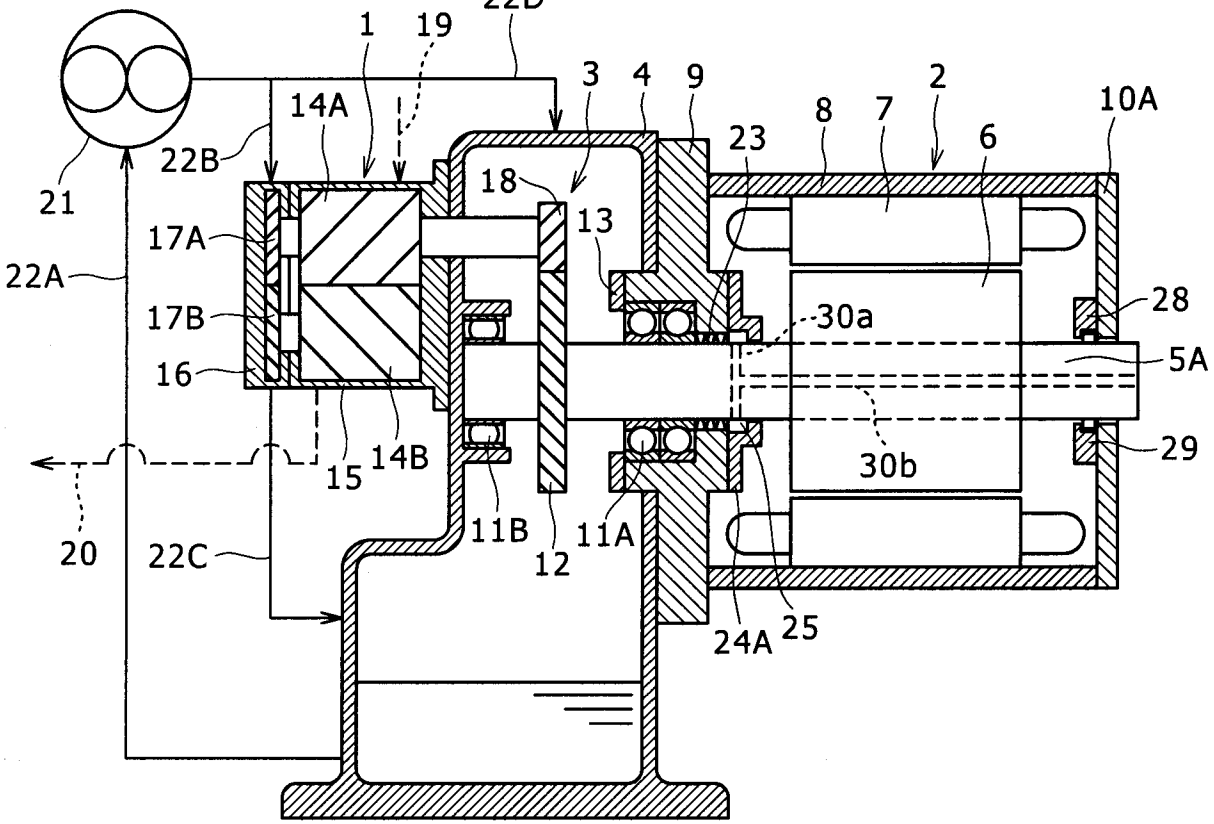
FIG. 2 shows a cross sectional structure of an air compressor in a second example together with an air system and an oil system.

FIG. 2 explains a second example. FIG. 2 shows a structure of an air compressor in this example together with an air system and an oil system. In FIG. 2, elements equivalent to those in the first example are given the same reference signs, and their explanation is abbreviated appropriately.

In this example, the non-load side end of a rotating shaft 5A of the electric motor 2 extends to the outside through a non-load side casing 10A. A non-load side seal cover 28 made of, e.g., aluminum is attached to the non-load side casing 10A. A contact type seal 29 is provided to a gap in the penetration portion of the rotating shaft 5A in the non-load side seal cover 28.

As in the first example, the groove 25 having a generally circular shape and larger than the through hole through which the rotating shaft 5 penetrates is formed in a load side seal cover 24A. Multiple radial communication holes 30*a* communicating with the groove 25 of the seal cover 24A and an axial communication hole 30*b* communicating with the communication holes 30*a* and extending to the non-load side end surface of the rotating shaft 5A are formed in the rotating shaft 5A.

That is, in this example, the load side casing 9 and seal cover 24A form a partitioning wall that defines the internal space of the gear casing 4 and the internal space of the electric motor main casing 8. The gap from the seal 23 toward the electric motor 2 in the partitioning wall (that is, the space in the groove 25) and the outside of the air compressor communicate with one another via the communication holes 30*a*, 30*b* not through the internal space of the electric motor main casing 8. Accordingly, ambient air can be supplied to the gap from the seal 23 toward the electric motor 2 via the communication holes 30*a* and 30*b* to prevent generation of a negative pressure in the internal space of the electric motor main casing 8. Therefore, even when a small gap is produced in the casing of the electric motor 2, dust can be prevented from intruding into the electric motor main casing 8 for improving reliability.

The first and second examples are explained in the example in which the load side casing 9 and seal cover 24 (or 24A) are formed as separate components, but not limited to this example. That is, the load side casing 9 and seal cover 24 (or 24A) may be formed as the same component, for example. In the first and second examples, the load side casing 9 is explained as part of the casing of the electric motor 2 for convenience, but may be considered as part of the gear casing 4. The load side casing 9 and gear casing 4 may be integrally formed as the same component, for example. Also in such a case, the same advantageous effect as described above can be obtained.

The first and second examples are explained in the example in which the rotating shaft 5 (or 5A) of the electric motor 2 is rotatably supported by the bearings 11A, 11B provided to the gear casing 4 and load side casing 9, and the rotor 6 located in the electric motor main casing 8 has an overhang relative to the bearings 11A, 11B, but not limited to this example. That is, for example, the rotating shaft 5 (or 5A) may be rotatably supported by bearings provided to the load side casing 9 and non-load side casing 10 (or 10A). Also in this case, the same advantageous effect as described above can be obtained.

The first and second examples are explained in the example in which the gear mechanism 3 is composed of a pair of gears 12 and 18, but is not limited to this example. That is, the gear mechanism 3 may be composed of two pairs of gears, for example. Specifically, the gear mechanism 3 may include: a drive gear provided to the load side end of the rotating shaft 5 (or 5A) of the electric motor 2 and a first intermediate gear meshing with the drive gear; a driven gear provided to the shaft portion of the male rotor 14A of the compressor body 1 and a second intermediate gear meshing with the driven gear; and an intermediate shaft to which the first and second intermediate gears are attached. Instead of the suction side shaft portion of the female rotor 14A, the suction side shaft portion of the female rotor 14B may extend from the compressor main casing 15 into the gear casing 4 and have a driven gear. Also in such a case, the same advantageous effect as described above can be obtained.

The first and second examples are explained in the example in which one compressor body 1 is provided, but not limited to this example. That is, two or more compressor bodies may be provided. Also in such a case, the same advantageous effect as described above can be obtained.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. An air compressor comprising:

a compressor body that compresses air;

an electric motor as a power source for the compressor body;

a gear mechanism that transmits power of the electric motor to the compressor body;

a gear casing that is connected between a casing of the compressor body and a casing of the electric motor and houses the gear mechanism;

a partitioning wall that defines an internal space of the gear casing and an internal space of the casing of the electric motor;

a screw seal that is located in a through hole formed in the partitioning wall, where a rotating shaft of the electric motor passes through, and makes an air flow from an electric motor side to a gear mechanism side in the through hole with rotation of the rotation shaft, bearings that support the rotating shaft, at least one bearing being arranged on the gear mechanism side of the partitioning wall, such that a rotor of the electric motor has an overhang structure relative to the bearings that support the rotating shaft, and a radial communication hole that communicates the electric motor side and an outside of the air compressor without going through the internal space of the casing of the electric motor, wherein the communication hole is axially adjacent to the screw seal, and the screw seal is interposed between the radial communication hole and all of the bearings that support the rotating shaft.

2. The air compressor according to claim 1 further comprising:

a lubricant flow path that slings a lubricant that accumulates in a lower portion of the gear casing on the bearing.

* * * * *